US010851509B2

(12) United States Patent
Kovalick

(10) Patent No.: US 10,851,509 B2
(45) Date of Patent: Dec. 1, 2020

(54) WEAR PAD ASSEMBLY FOR IMPLEMENTS OF MACHINES

(71) Applicant: Caterpillar Inc., Peoria, IL (US)

(72) Inventor: Benjamin J Kovalick, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 303 days.

(21) Appl. No.: 15/883,150

(22) Filed: Jan. 30, 2018

(65) Prior Publication Data

US 2019/0234034 A1 Aug. 1, 2019

(51) Int. Cl.

| | |
|---|---|
| ***E01H 5/06*** | (2006.01) |
| ***E02F 3/815*** | (2006.01) |
| ***E02F 9/28*** | (2006.01) |
| ***E02F 3/76*** | (2006.01) |

(52) U.S. Cl.

CPC ..... *E01H 5/066* (2013.01); *E01H 5/061* (2013.01); *E01H 5/062* (2013.01); *E02F 3/764* (2013.01); *E02F 3/7645* (2013.01); *E02F 3/8157* (2013.01); *E02F 9/2883* (2013.01)

(58) Field of Classification Search

CPC ..... E02F 3/8152; E02F 3/8157; E02F 9/2883
See application file for complete search history.

(56) References Cited

U.S. PATENT DOCUMENTS 2,651,121 A * 9/1953 Shannon ..... E01H 5/06 37/236
2,695,465 A 11/1954 Sully
2,756,522 A * 7/1956 Bomford ..... E02F 3/8157 172/832
2,794,273 A * 6/1957 Pilkington ..... E02F 3/8157 172/816
3,217,431 A * 11/1965 Heinzroth ..... E01H 5/066 37/270
4,450,635 A * 5/1984 Shwayder ..... E01H 5/061 228/189
4,607,781 A * 8/1986 Shwayder ..... B23K 31/02 228/175
5,140,763 A * 8/1992 Nichols, IV ..... E01H 5/062 37/233
5,185,946 A * 2/1993 Farrell ..... E01H 5/062 172/719

(Continued)

FOREIGN PATENT DOCUMENTS

| | | |
|---|---|---|
| DE | 29500723 | 1/1995 |
| WO | 2013174228 | 5/2012 |

*Primary Examiner* — Jessica H Lutz
(74) *Attorney, Agent, or Firm* — Oblon, McClelland, Maier & Neustadt

(57) ABSTRACT

A wear pad assembly for an implement of a machine is disclosed. The implement includes a forward face configured to engage and cast material sideways during a forward movement of the machine over a work surface, and a rearward face opposite the forward face. The wear pad assembly includes a first bracket, a second bracket, a wear pad, and a biasing member. The first bracket is configured to be fixedly coupled to the rearward face of the implement. The second bracket is pivotably coupled to the first bracket. The wear pad is coupled to the second bracket and is configured to contact the work surface. Further, the biasing member is engaged with the second bracket and is configured to bias the wear pad in abutment with the work surface during use of the implement.

16 Claims, 6 Drawing Sheets

(56) References Cited

U.S. PATENT DOCUMENTS

| | | | | |
|---|---|---|---|---|
| 6,352,126 | B1 * | 3/2002 | Brown | E02F 3/76 172/684.5 |
| 8,776,405 | B2 | 7/2014 | Paonessa | |
| 9,243,376 | B2 | 1/2016 | Guggino et al. | |
| 9,528,234 | B1 | 12/2016 | Pigeon | |
| 2006/0000122 | A1 * | 1/2006 | Micozzi | E01H 5/063 37/232 |
| 2009/0044433 | A1 * | 2/2009 | Hughes | E01H 5/062 37/266 |

* cited by examiner

WEAR PAD ASSEMBLY FOR IMPLEMENTS OF MACHINES

TECHNICAL FIELD

The present disclosure relates to a wear pad assembly for an implement of a machine. More particularly, the present disclosure relates to a wear pad assembly that is configured to adjust to various angular orientations of the implement relative to a work surface.

BACKGROUND

Implements, such as snow plows, are commonly applied to alter and reposition snow piled over an expanse of a roadway. For example, snow plows may be mounted to machines and then driven through the piled snow to scrape, remove, and cast the snow towards one or both sides of the roadway. Snow plows are known to include a blade with a scraping edge that is mated against the underlying snow to perform the aforementioned functions of scraping, removing, and moving. Furthermore, wear pads or skid shoes are commonly fitted in proximity to the scraping edge for contacting the work surface, and preventing premature wear of the scraping edge, and/or mitigating damage to the underlying roadway.

In order for these implements, such as snow plow blades, to adapt and work in diverse conditions, the blade (and in turn the scraping edge of the blade) may be orientated in a myriad of angles during operation. However, varying an angle of the blade, in one or more instances, may cause the wear pad to dig under the roadway, potentially gouging and damaging the roadway. Alternatively, it is possible that varying an angle of the blade may cause the scraping edge to be lifted relatively high above the roadway, leaving a layer of the underlying snow unaltered and unplowed during operation.

U.S. Pat. No. 8,776,405 ('405 reference) relates to a snow plow having a structure for adjusting to the contour of the surface being plowed. The snow plow includes a moldboard and a pair of opposed wing plates fixed to opposed longitudinal ends of the moldboard. The snow plow of the '405 reference includes a pair of a wear shoes for supporting a main plow body on the surface. Each wear shoe is pivotally mounted to the respective wing plate proximally to the moldboard so that the main plow body can pivot relative to the wear shoes.

SUMMARY OF THE INVENTION

In one aspect, the disclosure is directed towards a wear pad assembly for an implement of a machine. The implement includes a forward face configured to engage and cast material sideways during a forward movement of the machine over a work surface, and a rearward face opposite the forward face. The wear pad assembly includes a first bracket, a second bracket, a wear pad, and a biasing member. The first bracket is configured to be fixedly coupled to the rearward face of the implement, while the second bracket is pivotably coupled to the first bracket. The wear pad is coupled to the second bracket and is configured to contact the work surface. Further, the biasing member is engaged with the second bracket and is configured to bias the wear pad in abutment with the work surface during use of the implement.

In another aspect, the disclosure relates to an implement assembly for a machine. The implement assembly includes an implement configured to travel between a forward tipped state and a rearward tipped state relative to the machine. The implement includes a forward face configured to engage and cast material sideways during a forward movement of the machine over a work surface, and a rearward face opposite the forward face. Further, the implement assembly includes a wear pad that is pivotably coupled to the rearward face of the implement, and is configured to contact the work surface. Furthermore, the implement assembly includes a biasing member configured to bias and keep the wear pad in abutment with the work surface when the implement is in the forward tipped state and the rearward tipped state.

In yet another aspect, the disclosure is directed to a snow plow assembly for a machine. The snow plow assembly includes an implement configured to travel between a forward tipped state and a rearward tipped state relative to the machine. The implement includes a forward face configured to engage and cast material sideways during a forward movement of the machine over a work surface, and a rearward face opposite the forward face. Further, the snow plow includes a first bracket, a second bracket, a wear pad, and a biasing member. The first bracket is fixedly coupled to the rearward face of the implement. The second bracket is pivotably coupled to the first bracket. The wear pad is coupled to the second bracket and is configured to contact the work surface. Furthermore, the biasing member is engaged with the second bracket and is configured to bias the second bracket to keep the wear pad in abutment with the work surface when the implement is in the forward tipped state and the rearward tipped state.

DETAILED DESCRIPTION

Reference will now be made in detail to the preferred embodiments of the present disclosure, examples of which are illustrated in the accompanying drawings. Wherever possible, the same reference numbers will be used throughout the drawings to refer to the same or like parts.

Figure 1:
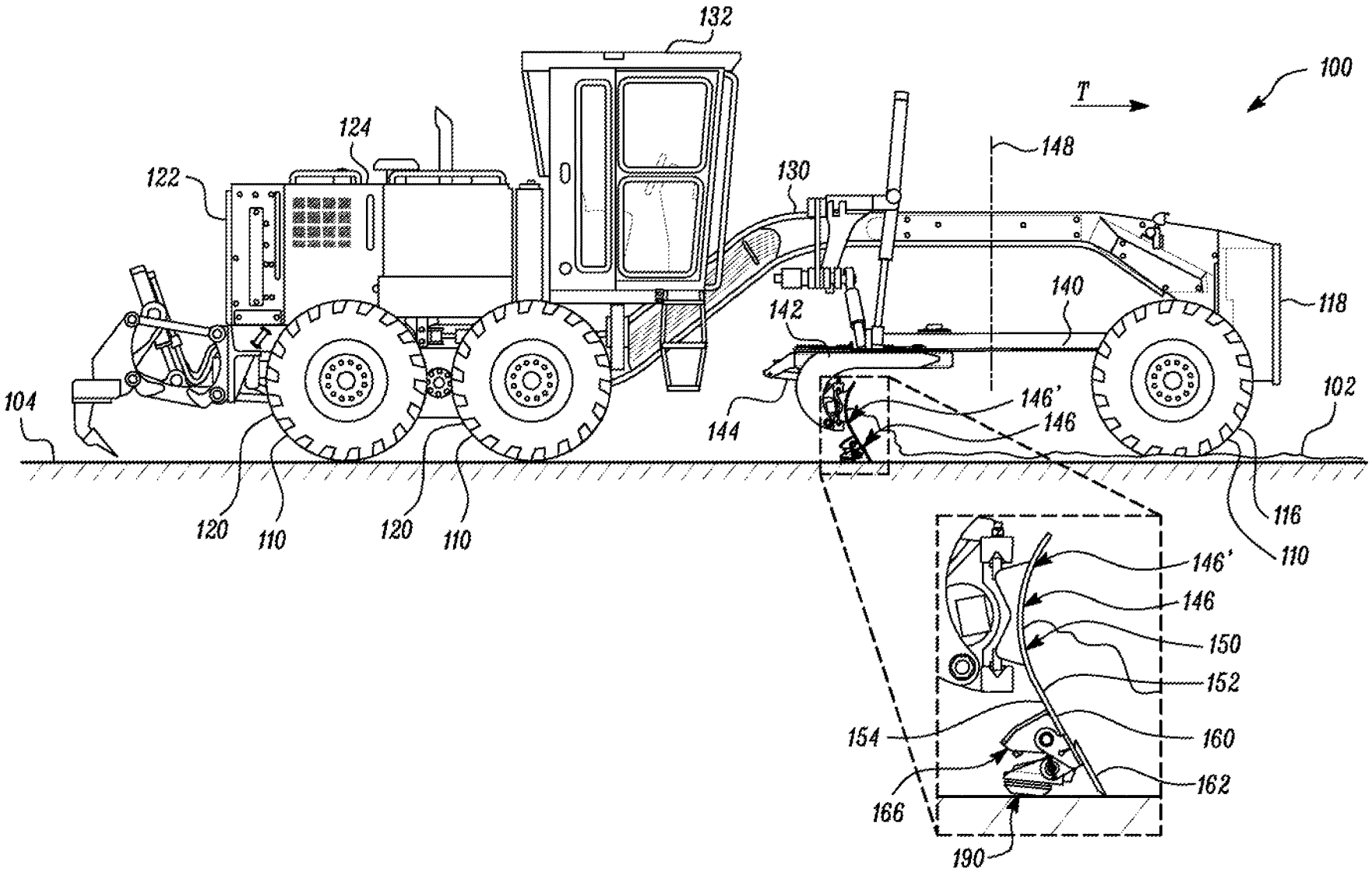
FIG. 1 is an exemplary machine having an implement assembly, in accordance with an embodiment of the present disclosure.

Referring to FIG. 1, an exemplary machine 100 is shown. The machine 100 is a motor grader. However, it is possible for the machine 100 to embody other machines, such as a pick-up truck, a dozer, a loader, etc. The machine 100 may be used to scrape, remove, and cast material 102, piled atop a work surface 104, towards one or both sides of the work surface 104. The material 102 may include snow, although it is possible for the material 102 to include rocks, sand, soil, rubble, gravel, debris, other disintegrated particles, etc. The work surface 104 may be a roadway, although an application of the aspects of the present disclosure may be contemplated over various other work surfaces, such as a pavement, a surface of a parking lot, etc.

Generally, the aforementioned functions of scraping, removing, and casting material 102 is performed during machine movement, and for enabling machine movement, the machine 100 may include traction devices 110, such as wheels, as shown. For example, the traction devices 110 include a set of forward wheels 116 disposed towards a forward end 118 of the machine 100 and a set of rearward wheels 120 disposed towards a rearward end 122 of the machine 100. The terms 'forward' and 'rearward', as used herein, are in relation to a direction of travel of the machine 100, as represented by arrow, T, in FIG. 1, with said direction of travel being exemplarily defined and visualized from the rearward end 122 towards the forward end 118. Further, the traction devices 110 may be powered by a power source, such as an internal combustion engine (not shown), housed in a power compartment 124 of the machine 100. The machine 100 may include a frame 130 and an operator cab 132. The operator cab 132 may be supported on the frame 130 and may house controls associated with the power source and various other functions of the machine 100.

The machine 100 may include a variety of components including a drawbar 140, a circle 142, a tipping actuator 144, and an implement assembly 146. Each of the drawbar 140, the circle 142, and the tipping actuator 144, may function in concert or independently to manipulate the implement assembly 146 in one or more orientations for casting the material 102 to the sides of the work surface 104. For example, the drawbar 140 may be used to raise and lower the implement assembly 146, the circle 142 may be used to rotate the implement assembly 146 (about a vertical axis 148), and the tipping actuator 144 may enable the implement assembly 146 to be tipped forward or rearward relative to the machine 100 (FIG. 2 exemplarily depicts the implement assembly 146 in a rearward tipped state, while FIG. 3 exemplarily depicts the implement assembly 146 in a forward tipped state). Although the implement assembly 146 is shown to be operably accommodated between the set of forward wheels 116 and the set of rearward wheels 120 in FIG. 1, it is possible for the implement assembly 146 to be mounted to the forward end 118 of the machine 100, at which place a connection to the drawbar 140 and to the circle 142 may be unwarranted and non-existent. Moreover, an application of the implement assembly 146 to other machines, such as to a pick-up truck, may include the implement assembly 146 being mounted to a foremost end of such machines. It will be appreciated, therefore, that a positioning of the implement assembly 146 is purely exemplary. Further, in some embodiments, the implement assembly 146 may be configured to scrape, plow, and remove snow from the work surface 104, and thus, the implement assembly 146 may be interchangeably referred to as a snow plow assembly 146'.

Figure 2:
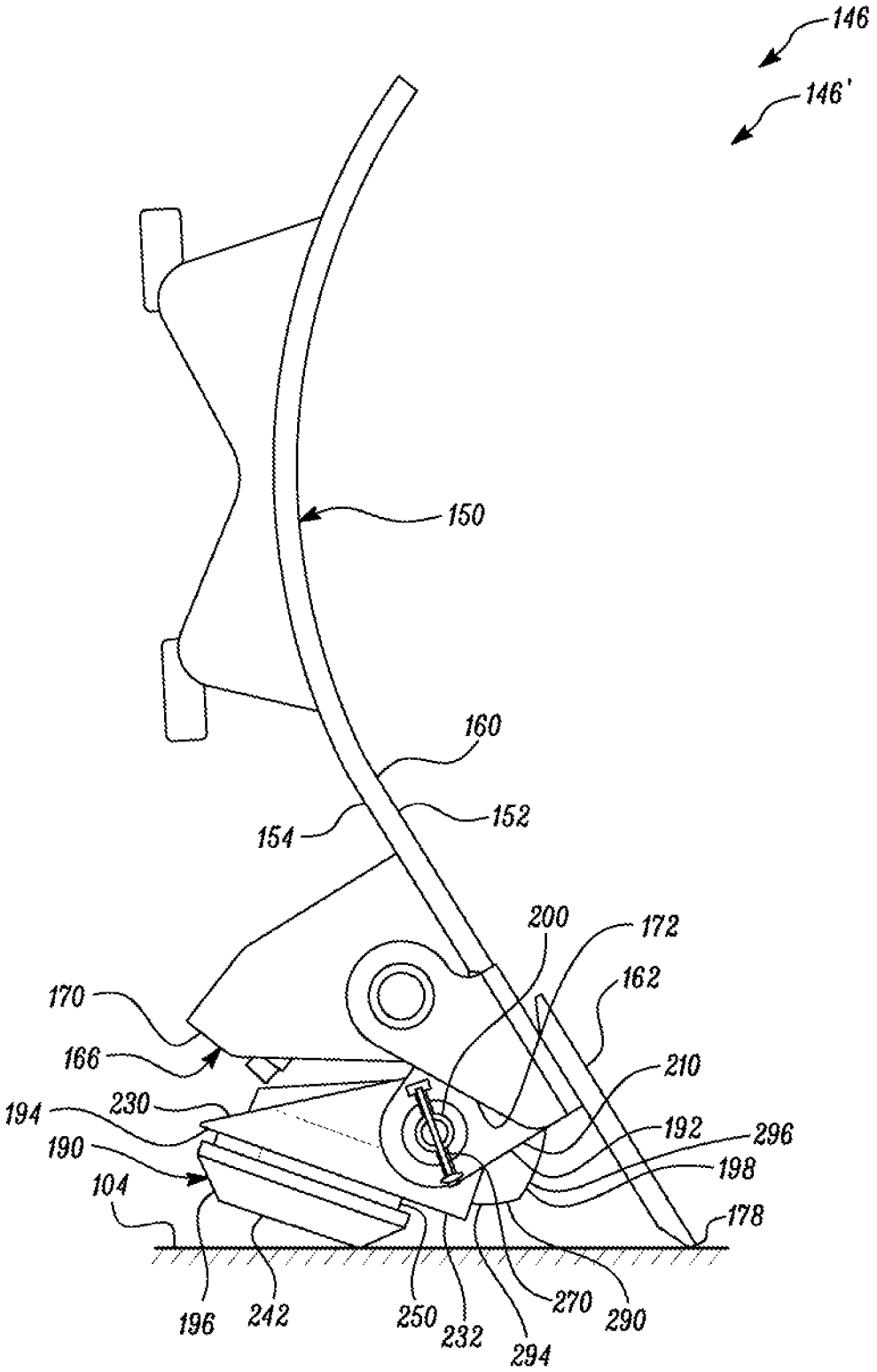
FIG. 2 is a view of the implement assembly of FIG. 1, depicted as a snow plow assembly, and having an exemplary implement in a rearward tipped state, in accordance with an embodiment of the present disclosure.
Figure 3:
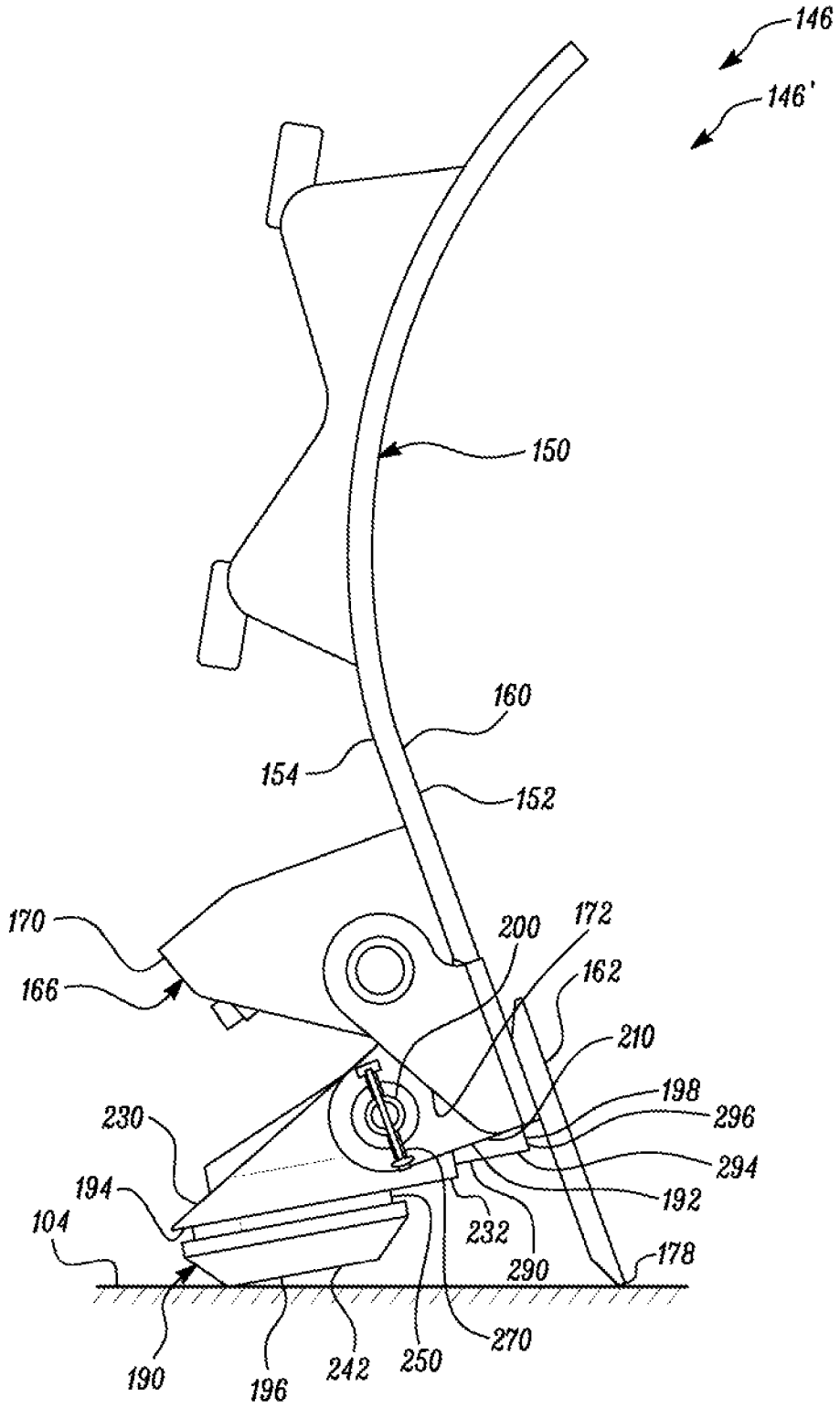
FIG. 3 is a view of the implement assembly of FIG. 1, with the implement in a forward tipped state, in accordance with an embodiment of the present disclosure.
Figure 4:
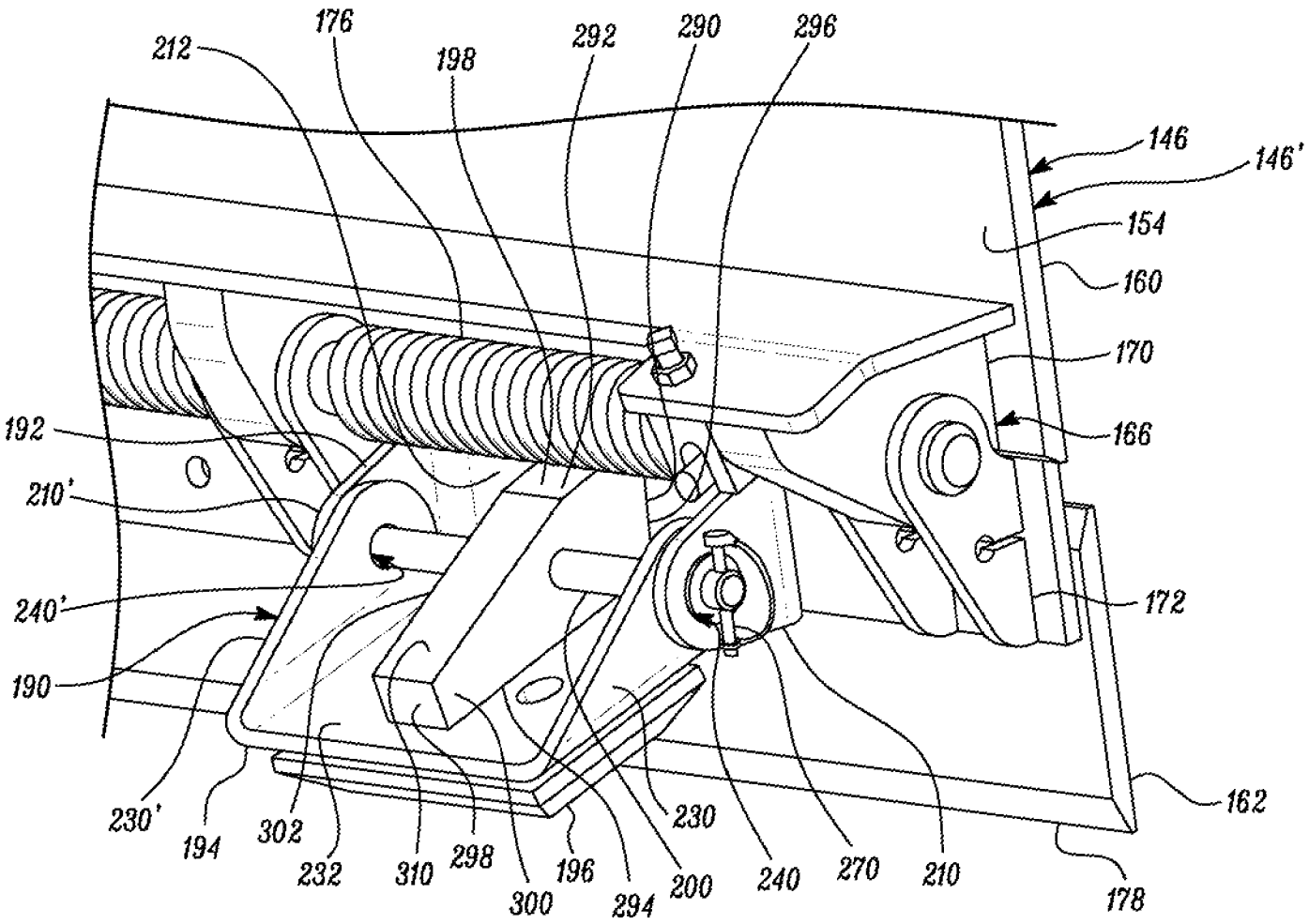
FIG. 4 is a perspective view of a wear pad assembly coupled to the implement of FIG. 1, in accordance with an embodiment of the present disclosure.

Referring to FIGS. 1, 2, and 3, the implement assembly 146 includes an implement 150. The implement 150 includes a forward face 152 configured to receive, engage, and cast material 102 sideways, during a forward movement (arrow, T, FIG. 1) of the machine 100 over the work surface 104. The implement 150 also includes a rearward face 154 that is opposite to the forward face 152. The implement 150 includes a moldboard portion 160 and a blade portion 162. As shown, the moldboard portion 160 and the blade portion 162 may be hinged to one another via a hinged mechanism 166 (the hinged mechanism 166 may also be visualized in FIGS. 4 and 6). The hinged mechanism 166 may include a first hinge 170 coupled to the moldboard portion 160 and a second hinge 172 coupled to the blade portion 162. In an embodiment, the first hinge 170 and the second hinge 172 may be both coupled to the same face (i.e., to the rearward face 154) of the implement 150. The first hinge 170 and the second hinge 172 may be pivotably coupled to each other, in turn enabling the moldboard portion 160 to be hinged relative to the blade portion 162. Further, the hinged mechanism 166 may include a biasing unit 176, as shown in FIG. 4, that may help the blade portion 162 retain a leading, scraping edge 178 against the underlying material 102 of the work surface 104, during a movement of the machine 100 over the work surface 104. In some embodiments, the moldboard portion 160 and the blade portion 162 may be integrally formed to define a fixed implement or a fixed blade, and, in such cases, the hinged mechanism 166 may be absent. Accordingly, a configuration of the implement 150 and the details of the hinged mechanism 166 are all purely exemplary as well. Therefore, all possible equivalents of the implement 150, including buckets, material pushers, etc., may also utilize one or more of the aspects discussed herein, without departing from the scope and spirit of the present disclosure.

Referring to FIGS. 1, 2, 3, 4, and 5, the implement assembly 146 is discussed. The implement assembly 146 includes a wear pad assembly 190 for the implement 150. The wear pad assembly 190 is assembled in proximity to the scraping edge 178 of the blade portion 162, and is configured to contact the work surface 104, during operation. The wear pad assembly 190 prevents premature wear of the scraping edge 178 and mitigates damage to the underlying work surface 104. The wear pad assembly 190 includes a first bracket 192, a second bracket 194, a wear pad 196, a biasing member 198, a pin 200, first fasteners 202, 202', and second fasteners 204, 204'.

Figure 5:
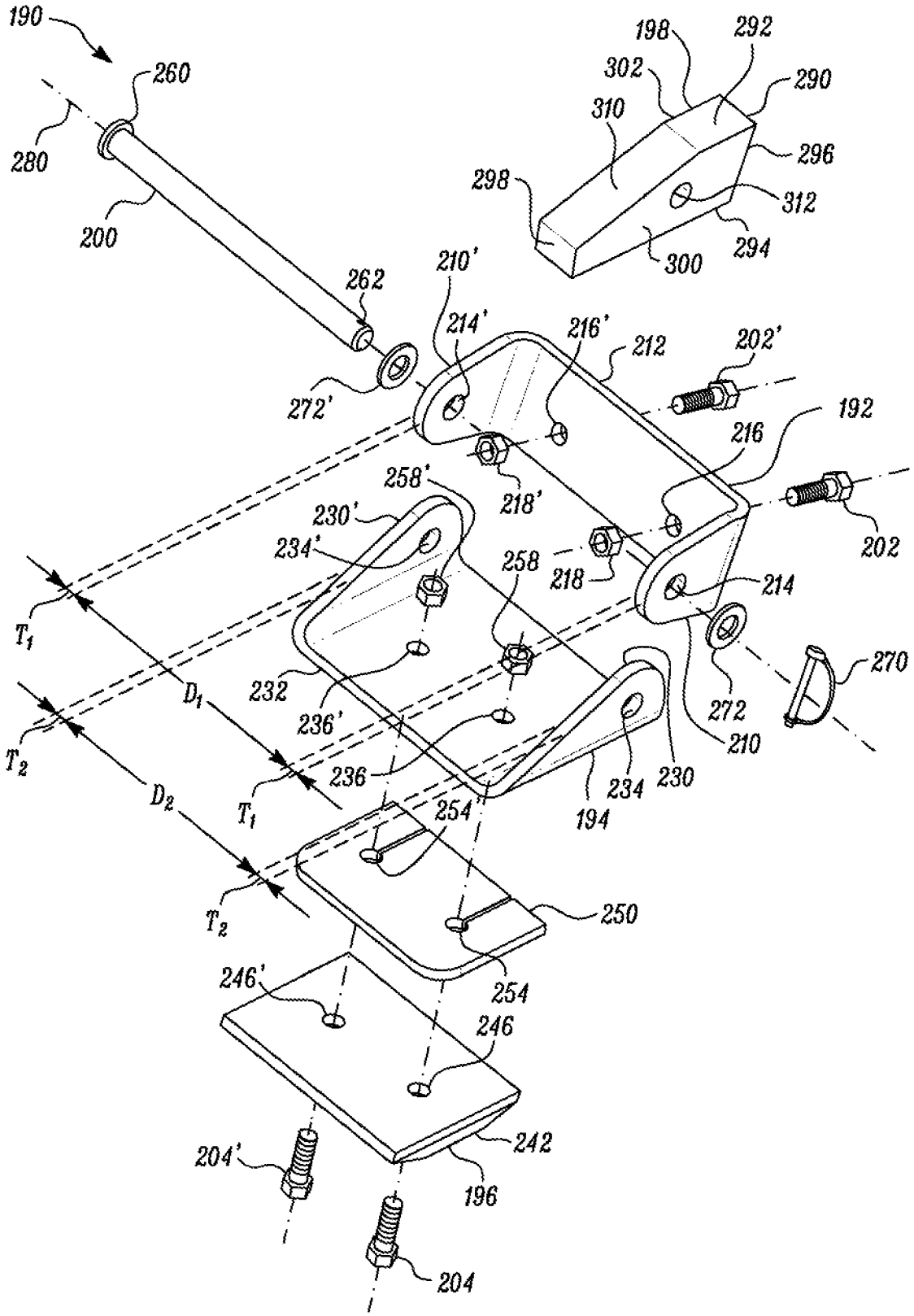
FIG. 5 is an exploded view of the wear pad assembly of FIG. 4, in accordance with an embodiment of the present disclosure.

Referring to FIG. 5, the first bracket 192 includes a pair of spaced apart sidewalls 210, 210' (or simply, first sidewalls 210, 210') and a base wall 212 that connects to and extends between the first sidewalls 210, 210'. As an example, the first sidewalls 210, 210' may be perpendicular to the base wall 212, and may be structured and arranged relative to the base wall 212 to impart a U-shaped profile to the first bracket 192. In some embodiments, the first bracket 192 may be formed from a single piece of sheet metal that have opposed end portions bent in the same direction, so as to define the U-shaped profile of the first bracket 192, and thus to also define the base wall 212 and the first sidewalls 210, 210' of the first bracket 192. Alternatively, the first bracket 192 may be formed by welding two or more plates together. For example, similarly sized end plates may be abutted and welded to opposed edges of a base plate. Together, the similarly sized end plates and the base plate may impart the U-shaped profile to the first bracket 192, and may also define the base wall 212 and the first sidewalls 210, 210' of the first bracket 192. Each of the first sidewalls 210, 210' include a first aperture (see first apertures 214, 214' annotated respectively for first sidewalls 210, 210'). The first aperture 214 of one first sidewall 210 may be co-axially aligned with the first aperture 214' of the other first sidewall 210'. The first sidewalls 210, 210' may define a distance, D1, between each other, and, moreover, each of the first sidewalls 210, 210' may include a thickness, T1.

Further, the base wall 212 may be configured to be fixedly coupled to the rearward face 154 of the implement 150. As an example, the base wall 212 of the first bracket 192 is affixed to the second hinge 172 (see FIG. 4) that is in turn coupled to the rearward face 154 of the implement 150, as shown. In some embodiments, the base wall 212 of the first bracket 192 includes openings 216, 216', and is coupled and secured to the first hinge 170 by way of first fasteners 202, 202' that may be respectively passed through the openings 216, 216' and be secured to the base wall 212 by way of nuts 218, 218'. First fasteners 202, 202' may include threaded fasteners, such as bolts. In cases where a usage of the hinged mechanism 166 is absent, the base wall 212 of the first bracket 192 may be directly coupled to the rearward face 154 of the implement 150.

The second bracket 194 is pivotably coupled to the first bracket 192. As with the first bracket 192, the second bracket 194 includes a pair of spaced apart sidewalls 230, 230' (or simply second sidewalls 230, 230') and a base wall 232 that connects to and extends between the second sidewalls 230, 230'. Moreover, the second sidewalls 230, 230' may be perpendicular to the base wall 232, as well, and may be structured and arranged to impart a U-shaped profile to the second bracket 194. Alike the first bracket 192, in some embodiments, the second bracket 194 may be formed from a single piece of sheet metal that have opposed end portions bent in the same direction to define the U-shaped profile of the second bracket 194, and thus to also define the base wall 232 and the second sidewalls 230, 230'. Alternatively. and as discussed for the first bracket 192, the second bracket 194 may be formed by welding two or more plates together, as well. For example, similarly sized end plates may be abutted and welded to opposed edges of a base plate. Together, the similarly sized end plates and the base plate may impart the U-shaped profile to the second bracket 194, and may also define the base wall 232 and the second sidewalls 230, 230' of the second bracket 194. Each of the second sidewalls 230, 230' include a second aperture (see second apertures 234, 234'), and the second aperture 234 of one second sidewall 230 may be co-axially aligned with the second aperture 234' of the other second sidewall 230'. The second sidewalls 230, 230' may define a distance, D2, between each other, and, moreover, each of the second sidewalls 230, 230' may include a thickness, T2. Further, the base wall 232 may include openings 236, 236' that may respectively receive the second fasteners 204, 204' for securing the wear pad 196 to the base wall 232. As with the first fasteners 202, 202', the second fasteners 204, 204' may include threaded fasteners, such as bolts, as well.

In some embodiments, the distance, D2, combined with thicknesses, T2, of the second sidewalls 230, 230', may be smaller than the distance, D1, defined between the first sidewalls 210, 210' (i.e., D2+T2+T2<D1). In that way, the second sidewalls 230, 230' of the second bracket 194 may be inserted in between the first sidewalls 210, 210' of the first bracket 192, for an assembly of the second bracket 194 to the first bracket 192. In some embodiments, the distance, D2, summated with thicknesses, T2, of the second sidewalls 230, 230' may together span the entire distance. D1. In so doing, the second sidewalls 230, 230' may sit substantially flush against the first sidewalls 210, 210', and an assembly of the second bracket 194 to the first bracket 192 may be attained with minimum (or negligible) play. In an assembly of the second bracket 194 to the first bracket 192, the second apertures 234, 234' may be co-axially aligned with the first apertures 214, 214'. Further, as an example, a first pivot joint 240 (see FIGS. 4 and 6) is defined by one first sidewall 210 and one second sidewall 230, while a second pivot joint 240' (see FIGS. 4 and 6) is defined by the other first sidewall 210' and the other second sidewall 230'.

Alternatively, and depending upon certain factors, such as spatial constraints, operational conditions, and/or other requirements, it is possible for the second bracket 194 to fit outside of the first bracket 192. In such a case, the distance, D1, summated with thicknesses. T1, of the first sidewalls 210, 210' may be smaller than distance, D2 (i.e., D1+T1+T1<D2) and, accordingly, the first bracket 192 may sit within the second bracket 194, in turn allowing the second bracket 194 to fit outside of the first bracket 192. In some embodiments, the distance, D1, summated with thicknesses, T1, of the first sidewalls 210, 210' may together span the entire distance, D2, and accordingly, an assembly of the first bracket 192 within the second bracket 194 may be attained with minimum (or negligible) play.

The wear pad 196 is coupled to the second bracket 194, and is thereby pivotably coupled to the rearward face 154 of the implement 150, and is also configured to contact the work surface 104 during operation. Although not limited, the wear pad 196 may include a shape and dimension that is compliant with a shape and dimension of the base wall 232 of the second bracket 194. The wear pad 196 may include a flat bottom surface 242 that may be configured to engage the work surface 104, during operation. The wear pad 196 may include a sacrificial wear component made from one or more of a number of materials, including, but not limited to, polymer, nylon, ceramic, a metallic material, or any low friction material, that may help the wear pad 196 slide relative to the work surface 104. Further, openings 246, 246' may be formed in the wear pad 196 through which the second fasteners 204, 204' may be passed for a securement of the wear pad 196 to the base wall 232 of the second bracket 194.

Optionally, one or more shims (see shim 250) may be added to the wear pad assembly 190, for a placement between the wear pad 196 and the base wall 232 of the second bracket 194. In so doing, a spacing between the base wall 232 of the second bracket 194 and the wear pad 196 may be adjusted, if needed. For example, the shim 250 may include openings 254, 254' that align respectively with the openings 246, 246' of the wear pad 196, and respectively with openings 236, 236' of the base wall 232. The second fastener 204 may be driven and secured through the aligned openings 246, 254, and 236, while the second fastener 204' may be driven and secured through the aligned openings 246', 254', and 236. Thereafter, nuts 258, 258' may be respectively coupled to the second fasteners 204, 204' to retain the wear pad 196 and the shim 250 with the base wall 232.

The pin 200 may be used to pivotably couple the first bracket 192 to the second bracket 194. For example, the pin 200 may be inserted and passed through both the first apertures 214, 214' and the second apertures 234, 234', respectively, for pivotably securing the first bracket 192 to the second bracket 194, and thereby defining the first pivot joint 240 and the second pivot joint 240'. The pin 200 may include a head portion 260 at one end and a slot 262 at the other end. In an assembled state of the first bracket 192 with the second bracket 194, the head portion 260 may be abutted against the first sidewall 210', as shown, while the slot 262 may extend beyond the first sidewall 210, thereby jutting outwardly of the assembly of the first bracket 192 and the second bracket 194. A retainer pin 270 may be passed through the slot 262 to retentively couple the pin 200 to the assembly of the first bracket 192 and the second bracket 194, which in turn enables the pin 200 to pivotably couple and retain the second bracket 194 to the first bracket 192. Additionally, or optionally, one or more first washers 272 may be applied between the first sidewall 210 and the retainer pin 270, and, similarly, one or more second washers 272' may be applied between the head portion 260 and the first sidewall 210'. Further, the pin 200 may define a pivot axis 280 about which the second bracket 194 may be pivoted relative to the first bracket 192.

The biasing member 198 may be configured to bias the second bracket 194 away from the first bracket 192. More particularly, the biasing member 198 may be engaged with the second bracket 194 and configured to bias the wear pad 196 in abutment with the work surface 104 during use of the implement 150. Exemplarily, the biasing member 198 may include a block 290 formed from a non-metallic compressible material. The block 290 may include a generally cuboidal shape with a top face 292, a bottom face 294, and a side face 296 (or an inner side face 296) extending between the top face 292 and the bottom face 294. The block 290 also includes an outer side face 298 opposite to the inner side face 296, and two oppositely defined, similarly laid out lateral faces. As an example, only one lateral face 300 is exclusively shown in the figures. The other lateral face 302 may be visualized as being similar and oppositely disposed to the lateral face 300. Discussions pertaining to the lateral face 300 will be applicable to the other, oppositely disposed lateral face 302, as well.

The lateral face 300 extends to each of the outer side face 298, the inner side face 296, the bottom face 294, and the top face 292. The inner side face 296 extends from the bottom face 294 at an angle to the bottom face 294. In one example, the angle between the bottom face 294 and the inner side face 296 is 90 degrees. In another example, an angle between the inner side face 296 and the bottom face 294 includes an obtuse angle. In yet other examples, an angle between the inner side face 296 and the bottom face 294 is a function of, or is equal to a maximum attainable angle between the first bracket 192 and the second bracket 194 about the pivot axis 280. In an assembly of the second bracket 194 with the first bracket 192, the inner side face 296 may be abutted (or coupled) to the first bracket 192 (i.e., to the base wall 212 of the first bracket 192), while the bottom face 294 may be abutted (or coupled) to the second bracket 194 (i.e., to the base wall 232 of the second bracket 194). During operation, force may be applied against the inner side face 296 by the first bracket 192, and in response, the inner side face 296 may be angularly compressed towards the bottom face 294 (owing to a pivotal motion between the first bracket 192 and the second bracket 194), thereby biasing the second bracket 194 away from the first bracket 192.

In some embodiments, and as shown, the top face 292 of the block 290 includes a sloping roof portion 310. The sloping roof portion 310 may form an interface extending between the outer side face 298 and the top face 292, and may be tilted to each of the outer side face 298 and the top face 292. For example, the sloping roof portion 310 extends from the top face 292 and is inclined towards the bottom face 294. In some embodiments, however, the top face 292 and the outer side face 298 may be non-existent, and the sloping roof portion 310 may extend directly from the inner side face 296 to the bottom face 294, thereby imparting a triangular configuration to the block 290. Further, the block 290 includes a through-hole 312 extending through and across the block 290, from the lateral face 300 to the oppositely disposed, other lateral face 302. The through-hole 312 may provide passage for the pin 200 to be disposed through the block 290. In that way, the block 290 (and thus the biasing member 198) may be engaged with the pin 200, and thus the block 290 may be retained between the first bracket 192 and the second bracket 194. As an example, the block 290 is formed from Polyurethane. However, it is possible for other materials, such as polymers, rubber, etc., singularly or in combination with each other, to be applied for the formation of the block 290 (or the biasing member 198).

Figure 6:
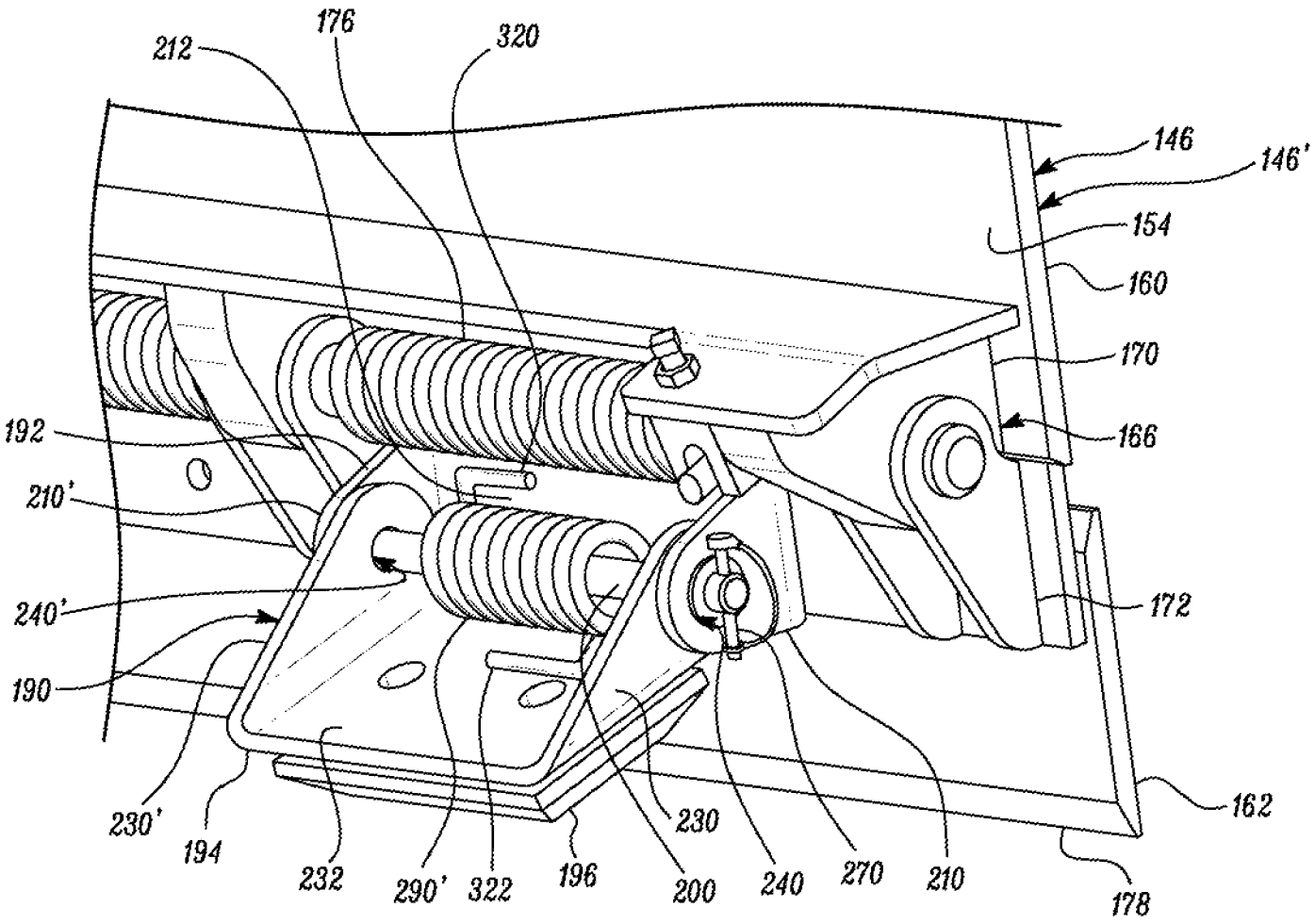
FIG. 6 is a perspective view of a wear pad assembly coupled to the implement of FIG. 1, in accordance with an alternate embodiment of the present disclosure.

Referring to FIG. 6, in yet some embodiments, the block 290 is omitted, and instead, a torsion spring 290' is assembled around the pin 200, and is thus engaged with the pin 200 for application as the biasing member 198 between the first bracket 192 and the second bracket 194. As shown, the torsion spring 290' may include one end 320 in engagement with the base wall 212 of the first bracket 192, while another end 322 in engagement with the base wall 232 of the second bracket 194, biasing the second bracket 194 away from the first bracket 192. Further alternatives of the biasing member 198 may be contemplated as well.

INDUSTRIAL APPLICABILITY

During operation, the machine 100 is driven through the material 102, so as to clear the material piled over the work surface 104. Depending upon a variety of conditions, such as a state of the material (i.e., whether the material is soft or hard), or a fragility of the work surface 104, environmental factors, operational parameters, etc., it is possible for the implement 150 (and thus the scraping edge 178 of the blade portion 162) to be moved to the forward tipped state (see FIG. 3) or to the rearward tipped state (see FIG. 2), relative to the machine 100. It may be noted that in both the forward tipped state (see FIG. 3) and in the rearward tipped state (see FIG. 2), the wear pad 196 may be in contact with the work surface 104.

Upon a movement of the implement 150 from the forward tipped state (see FIG. 3) to the rearward tipped state (see FIG. 2), the first bracket 192 angularly moves towards the second bracket 194. During the angular movement (and if the block 290 were applied as the biasing member 198 between the first bracket 192 and the second bracket 194), the first bracket 192 may exert a force against the inner side face 296 of the block 290, compress and deform the block 290, and may transmit the force to the second bracket 194 through the bottom face 294 of the block 290. This biasing force helps the second bracket 194 (and thus the wear pad 196) stay in uninterrupted abutment with the work surface 104 throughout the movement of the implement 150 from the forward tipped state (see FIG. 3) to the rearward tipped state (see FIG. 2). The biasing force of the biasing member 198 also keeps the wear pad 196 in abutment with the work surface 104 when the implement 150 is in the rearward tipped state (see FIG. 2). With such a mechanism, the wear pad assembly 190 refrains from moving or gouging into/under the work surface 104, and refrains from extending below the scraping edge 178 of the blade portion 162. Moreover, the implement 150 (and the scraping edge 178 of the implement 150) also remains engaged with the work surface 104 in the rearward tipped state (see FIG. 2), leaving substantially no room for any layer of material 102 to remain unaltered and/or unplowed.

Conversely, when a movement of the implement 150 is executed from the rearward tipped state (see FIG. 2) to the forward tipped state (see FIG. 3), the biasing member 198 (such as the block 290) is released from compression, and the first bracket 192 angularly moves away from the second bracket 194. Throughout the movement of the implement 150 from the rearward tipped state (see FIG. 2) to the forward tipped state (see FIG. 3), the biasing member 198 may continue to offer the biasing force to maintain the wear pad 196 in uninterrupted abutment with the work surface 104. The biasing force of the biasing member 198 may also keep the wear pad 196 in abutment with the work surface 104 when the implement 150 is in the forward tipped state (see FIG. 3).

An application of the torsion spring 290' may be similar to the application of the block 290, as discussed above. Further, the application of the wear pad assembly 190, according to aspects of the present disclosure, helps overcome one pertinent drawback, among many others, of a conventional practice that involved an application of a fixed wear pad assembly. Application of a fixed wear pad assembly may gouge a relatively fragile, delicate underlying work surface, or may engage and undesirably raise an associated implement above a work surface, hampering material altering (such as snow plowing) operations. With the use of the wear pad assembly 190, as discussed herein, the work surface 104 is effectively kept from damage, and a vulnerability for the scraping edge 178 of the blade portion 162 to be unduly raised above the work surface 104, entailing that material 102 may be left unaltered and/or unplowed, is substantially mitigated. Further, since the wear pad assembly 190 may automatically adjust according to a position of the implement 150, a need to repeatedly adjust and/or remove the wear pad 196 for different applications may be avoided. The automatic adjustment of the wear pad assembly 190, as discussed, also reduces effort associated with manual wear pad adjustments.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A wear pad assembly for an implement of a machine, the implement including a forward face configured to engage and cast material sideways during a forward movement of the machine over a work surface, and a rearward face opposite the forward face, the wear pad assembly comprising:

a first bracket configured to be fixedly coupled to the rearward face of the implement;

a second bracket; a pin passing through the first bracket and the second bracket to pivotably couple the first bracket to the second bracket;

a wear pad directly coupled to the second bracket and configured to contact the work surface; and a biasing member engaged with the second bracket and configured to bias the wear pad in abutment with the work surface during use of the implement.

2. The wear pad assembly of claim 1, wherein the biasing member is engaged with the pin.

3. The wear pad assembly of claim 1, wherein each of the first bracket and the second bracket includes a pair of spaced apart sidewalls and a base wall extending between the pair of spaced apart sidewalls, and wherein the base wall of the first bracket is configured to be fixedly coupled to the rearward face of the implement, the base wall of the second bracket is coupled to the wear pad, and the pin passes through the pair of spaced apart sidewalls to pivotably couple the second bracket to the first bracket.

4. The wear pad assembly of claim 1, wherein the biasing member includes a block formed from a non-metallic compressible material, and includes a side face abutted against the first bracket and a bottom face abutted against the second bracket.

5. The wear pad assembly of claim 1, wherein the biasing member is formed from Polyurethane.

6. The wear pad assembly of claim 1, wherein the biasing member includes a torsion spring.

7. An implement assembly for a machine, the implement assembly comprising:

an implement configured to travel between a forward tipped state and a rearward tipped state relative to the machine, the implement including a forward face configured to engage and cast material sideways during a forward movement of the machine over a work surface, and a rearward face opposite the forward face;

a first bracket configured to be fixedly coupled to the rearward face of the implement and a second bracket pivotably coupled to the first bracket;

a wear pad coupled to the second bracket, the wear pad being configured to pivot relative to the forward face and the rearward face of the implement and configured to contact the work surface; and a pin passing through the first bracket and the second bracket to pivotably couple the first bracket to the second bracket, and thereby pivotably coupling the wear pad to the rearward face of the implement.

8. The implement assembly of claim 7, wherein each of the first bracket and the second bracket includes a pair of spaced apart sidewalls and a base wall extending between the pair of spaced apart sidewalls, and wherein the base wall of the first bracket is configured to be fixedly coupled to the rearward face of the implement, the base wall of the second bracket is coupled to the wear pad, and the pin passes through the pair of spaced apart sidewalls to pivotably couple the second bracket to the first bracket.

9. The implement assembly of claim 7, wherein the biasing member includes a block formed from a non-metallic compressible material, and includes a side face abutted against the first bracket and a bottom face abutted against the second bracket.

10. The implement assembly of claim 7, wherein the biasing member is formed from Polyurethane.

11. The implement assembly of claim 7, wherein in the rearward tipped state a front portion of the wear pad is configured to abut with the work surface and in the forward tipped state a rear portion of the wear pad is configured to abut with the work surface.

12. A snow plow assembly for a machine, the snow plow assembly comprising:

an implement configured to travel between a forward tipped state and a rearward tipped state relative to the machine, the implement including a forward face configured to engage and cast material sideways during a forward movement of the machine over a work surface, and a rearward face opposite the forward face;

a first bracket fixedly coupled to the rearward face of the implement;

a second bracket; a pin passing through the first bracket and the second bracket to pivotably couple the first bracket to the second bracket;

a wear pad coupled to the second bracket and configured to contact the work surface; and a biasing member engaged with the second bracket and configured to bias the second bracket to keep the wear pad in abutment with the work surface when the implement is in the forward tipped state and the rearward tipped state.

13. The snow plow assembly of claim 12, wherein each of the first bracket and the second bracket includes a pair of spaced apart sidewalls and a base wall extending between the pair of spaced apart sidewalls, and wherein the base wall of the first bracket is configured to be fixedly coupled to the rearward face of the implement, the base wall of the second bracket is coupled to the wear pad, and the pin passes through the pair of spaced apart sidewalls to pivotably couple the second bracket to the first bracket.

14. The snow plow assembly of claim 12, wherein the biasing member is engaged with the pin.

15. The snow plow assembly of claim 12, wherein the biasing member includes a block formed from a non-metallic compressible material, and includes a side face abutted against the first bracket and a bottom face abutted against the second bracket.

16. The snow plow assembly of claim 12, wherein the implement includes an upper portion and a lower portion pivotally coupled to each other according to a first pivot, and wherein the wear pad is pivotally coupled to the implement according to a second pivot different from the first pivot.

* * * * *